US008251673B2

(12) United States Patent
Taguchi

(10) Patent No.: US 8,251,673 B2
(45) Date of Patent: Aug. 28, 2012

(54) DISPLACEMENT CONTROL VALVE OF A VARIABLE DISPLACEMENT COMPRESSOR

(75) Inventor: Yukihiko Taguchi, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 713 days.

(21) Appl. No.: 12/373,846

(22) PCT Filed: Jul. 2, 2007

(86) PCT No.: PCT/JP2007/063213

§ 371 (c)(1),
(2), (4) Date: Jan. 14, 2009

(87) PCT Pub. No.: WO2008/010404

PCT Pub. Date: Jan. 24, 2008

(65) Prior Publication Data

US 2009/0246041 A1 Oct. 1, 2009

(30) Foreign Application Priority Data

Jul. 19, 2006 (JP) ..... 2006-196396

(51) Int. Cl.
*F04B 1/26* (2006.01)

(52) U.S. Cl. ..... 417/222.2; 417/269; 417/270; 137/625.65; 251/318; 251/61.2; 251/61.5

(58) Field of Classification Search ..... 417/269, 417/222.2, 270; 137/625.65; 251/129.01, 251/129.04, 318, 61.2, 61.5, 129.03
See application file for complete search history.

(56) References Cited

U.S. PATENT DOCUMENTS

| | | | | |
|---|---|---|---|---|
| 4,685,866 | A * | 8/1987 | Takenaka et al. | 417/222.2 |
| 4,747,754 | A * | 5/1988 | Fujii et al. | 417/222.2 |
| 5,145,326 | A * | 9/1992 | Imura et al. | 417/222.2 |
| RE35,672 | E * | 11/1997 | Taguchi | 417/222.2 |
| 5,890,876 | A * | 4/1999 | Suito et al. | 417/213 |
| 6,354,811 | B1 * | 3/2002 | Ota et al. | 417/222.2 |
| 7,121,811 | B2 * | 10/2006 | Hirota | 417/222.2 |

(Continued)

FOREIGN PATENT DOCUMENTS

JP H11-107929 A 4/1999

(Continued)

OTHER PUBLICATIONS

Japanese Patent Office, International Search Report for International Application No. PCT/JP2007/063213, mailed Sep. 4, 2007.

(Continued)

*Primary Examiner* — Nimeshkumar Patel
*Assistant Examiner* — Jose M Diaz
(74) *Attorney, Agent, or Firm* — Baker Botts L.L.P.

(57) ABSTRACT

A displacement control valve of a variable displacement compressor opens and closes a communication passage extending between a portion of the compressor on which discharge pressure acts and a crank chamber of the compressor. The displacement of the compressor is controlled, such that discharge chamber pressure does not act on the valve body in the opening and closing direction, and pressures acting on the opposite ends of the valve body are maintained at the same level.

25 Claims, 5 Drawing Sheets

U.S. PATENT DOCUMENTS

| | | | | |
|---|---|---|---|---|
| 7,771,175 | B2 * | 8/2010 | Ota et al. | 417/269 |
| 2005/0035321 | A1 * | 2/2005 | Uemura et al. | 251/129.03 |
| 2006/0039799 | A1 * | 2/2006 | Hirota | 417/222.2 |
| 2006/0218953 | A1 * | 10/2006 | Hirota | 62/228.5 |
| 2006/0237552 | A1 * | 10/2006 | Umemura et al. | 236/92 B |
| 2006/0280616 | A1 * | 12/2006 | Umemura et al. | 417/222.2 |
| 2007/0012057 | A1 * | 1/2007 | Umemura et al. | 62/228.3 |
| 2007/0145315 | A1 * | 6/2007 | Uemura et al. | 251/84 |
| 2009/0057586 | A1 * | 3/2009 | Cho et al. | 251/129.15 |
| 2009/0114871 | A1 * | 5/2009 | Iwa | 251/318 |

FOREIGN PATENT DOCUMENTS

| | | | |
|---|---|---|---|
| JP | 2001-073940 | A | 3/2001 |
| JP | 2006-177210 | A | 7/2006 |

OTHER PUBLICATIONS

Japanese Patent Office, Written Opinion of the International Searching Authority for International Application No. PCT/JP2007/063213, mailed Sep. 4, 2007.

* cited by examiner

Fig.3

$$F(i)+f2+Sr\cdot Pc+(Sb-Sr)\cdot Ps-f1=0$$

$$Ps=-\frac{1}{Sb-Sr}\cdot F(i)-\frac{Sr}{Sb-Sr}\cdot Pc+\frac{f1-f2}{Sb-Sr} \quad \ldots(1)$$

Pc : Crank chamber pressure

Ps : Suction chamber pressure

Sr : Cross sectional area of pressure sensitive rod

Sb : Effective area of bellows f1 : Biasing force of bellows f2 : Biasing force of spring 310

F(i) : Electromagnetic force $$f3+Sr\cdot Pc+(Sd-Sr)\cdot Ps+F(i)-f1-f2=0$$

$$Ps=-\frac{1}{Sd-Sr}\cdot F(i)-\frac{Sr}{Sd-Sr}\cdot Pc+\frac{f1+f2-f3}{Sd-Sr} \quad \ldots(2)$$

Pc : Crank chamber pressure

Ps : Suction chamber pressure

Sr : Cross sectional area of pressure sensitive rod

Sd : Effective area of diaphragm f1 : Biasing force of spring 408 f2 : Biasing force of spring 411 f3 : Biasing force of spring 416

F(i) : Electromagnetic force

DISPLACEMENT CONTROL VALVE OF A VARIABLE DISPLACEMENT COMPRESSOR

CROSS-REFERENCE TO RELATED APPLICATIONS

This application is the National Stage of International Patent Application No. PCT/JP2007/063213, filed Jul. 2, 2007, which claims the benefit of Japanese Patent Application No. 2006-196396, filed Jul. 19, 2006, the disclosures of which are incorporated herein by reference in their entirety.

TECHNICAL FIELD

The present invention relates to a displacement control valve of a variable displacement compressor.

BACKGROUND ART

Patent Document No. 1 teaches a displacement control valve of a variable displacement compressor for opening and closing a communication passage extending between a portion of the compressor on which discharge pressure acts and a crank chamber of the compressor, thereby controlling the displacement of the compressor, comprising a valve hole communicating with the crank chamber at one end and opening to a valve chamber at the other end, a valve body for opening and closing the valve hole at one end located in the valve chamber communicating with the portion of the compressor on which discharge pressure acts, a bulkhead provided with a supporting hole for slidably supporting the valve body and shutting the other end of the valve body off from the valve chamber, a pressure inlet passage for allowing crank chamber pressure to act on the other end of the valve body, and a driver for driving the valve body in a direction for opening and closing the valve hole.

The displacement control valve taught by Patent Document No. 1 has an advantage in that discharge chamber pressure does not act on the valve body in the direction for opening and closing the valve hole.

Patent Document No. 1: Japanese Patent Laid-Open Publication No. 11-107929

DISCLOSURE OF INVENTION

Problem to be Solved

The displacement control valve of Patent Document No. 1 has the following problems.

(1) The structure of the displacement control valve is complex because the pressure inlet passage for allowing crank chamber pressure to act on the other end of the valve body is disposed independent of the communication passage extending between the portion of the compressor on which discharge pressure acts and the crank chamber of the compressor.

(2) The pressure inlet passage functions to lead discharge gas leaked from the valve chamber to the side of the other end of the valve body through a space between the valve body and the supporting hole to the crank room, in addition to functioning to allow the crank chamber pressure to act on the other end of the valve body. Therefore, the pressure inlet passage desirably has sufficiently large cross sectional area. However, it is hard to increase the cross sectional area of the pressure inlet passage to a sufficiently large level because of various restrictions imposed on space, layout, etc. As a result, when the sliding contact part between the valve body and the supporting hole wears away owing to deterioration with age, etc., to increase the space between the valve body and the supporting hole, thereby increasing the flow rate of the discharge gas leaking from the valve chamber to the side of the other end of the valve body and the flow rate of the discharge gas through the pressure inlet passage, pressure loss is generated in the pressure inlet passage to make the pressure acting on the other end of the valve body higher than the crank chamber pressure acting on the one end of the valve body, thereby forcing the valve body in the direction for closing the valve hole and causing the control characteristic of the suction chamber pressure to deviate from the initial characteristic.

An object of the present invention is to provide a displacement control valve of a variable displacement compressor for opening and closing a communication passage extending between a portion of the compressor on which discharge pressure acts and a crank chamber of the compressor, thereby controlling the displacement of the compressor, wherein discharge chamber pressure does not act on the valve body in the opening and closing direction, pressures acting on the opposite ends of the valve body are reliably maintained at the same level, and the structure thereof is simple.

Means for Achieving the Object

In accordance with the present invention, there is provided a displacement control valve of a variable displacement compressor for opening and closing a communication passage extending between a portion of the compressor on which discharge pressure acts and a crank chamber of the compressor, thereby controlling the displacement of the compressor, comprising a valve hole communicating with the crank chamber at one end and opening to a valve chamber at the other end, a valve body for opening and closing the valve hole at one end located in the valve chamber communicating with the portion of the compressor on which discharge pressure acts, a bulkhead provided with a supporting hole for slidably supporting the valve body and shutting the other end of the valve body off from the valve chamber, and a driver for driving the valve body in a direction for opening and closing the valve hole, wherein the other end of the valve body is disposed in a portion of the communication passage closer to the crank chamber than the valve hole.

In the displacement control valve in accordance with the present invention, discharge chamber pressure does not act on the valve body in the opening and closing direction because crank chamber pressure acts on the opposite ends of the valve body. The crank chamber pressure is applied to the other end of the valve body not by disposing a pressure inlet passage but by disposing the other end of the valve body in a portion of the communication passage extending between a portion of the compressor on which discharge pressure acts and a crank chamber of the compressor closer to the crank chamber than the valve hole. Therefore, structure of the displacement control valve in accordance with the present invention is simpler than that of the conventional displacement control valve. Even if discharge gas leaks to the side of the other end of the valve body through the space between the valve body and the supporting hole, the leaked gas does not affect to the crank chamber pressure acting on the other end of the valve body because the other end of the valve body is located in the communication passage and the communication passage has a sectional area large enough even to lead the discharge gas to the crank chamber. As a result, the crank chamber pressure reliably acts on the opposite ends of the valve body. Therefore, control characteristic of the suction chamber pressure does not deviate from the initial characteristic.

In accordance with a preferred embodiment of the present invention, the valve body is provided with a cylindrical circumferential surface having a single diameter over the whole length and line contacts a valve seat at the outer peripheral portion of the one end when it closes the valve hole.

The aforementioned structure can completely eliminate the action of the discharge chamber pressure on the valve body in the opening and closing direction and completely prevent opening and closing control of the valve body from being impaired by the discharge pressure.

In accordance with a preferred embodiment of the present invention, the valve seat forms a flat surface, a concavity is formed on the one end of the valve body, and the outer peripheral portion of the concavity forms an annular sharp edge to form the outer peripheral portion of the one end of the valve body.

When a concave is formed on the one end of the valve body, it becomes possible to make the outer peripheral portion of the one end of the valve body form an annular sharp edge for line contacting the valve seat. When the valve seat forms a flat surface, leakage from the valve is prevented even if the central axis of the valve body drifts.

In accordance with a preferred embodiment of the present invention, the valve hole is formed in the one end of the valve body, a hole is formed in the valve body to extend from the valve hole to the other end of the valve body, and the valve hole formed in the one end of the valve body and the hole extending from the valve hole to the other end of the valve body form a part of the communication passage.

When a part of the communication passage is formed in the valve body, it becomes unnecessary to form the part of the communication passage in the valve casing. As a result, the structure of the displacement control valve is simplified.

In accordance with a preferred embodiment of the present invention, the driver comprises a pressure sensitive mechanism for self controlling the internal pressure of a suction chamber and an electromagnetic actuator for changing an operating point of the pressure sensitive mechanism.

Provision of a pressure sensitive mechanism enhances the accuracy of the control of the suction chamber pressure. Provision of an electromagnetic actuator for changing an operating point of the pressure sensitive mechanism enables the control pressure of the suction chamber to be determined unitarily relative to the control electric current.

In accordance with a preferred embodiment of the present invention, the displacement control valve further comprising a forced opening mechanism for forcing the valve body to move away from the valve seat to open the valve hole when an electric supply to the electromagnetic actuator is stopped.

Provision of a mechanism for forcing the valve hole to open enables the displacement of the variable displacement compressor to rapidly decrease to the minimum level when the operation of the variable displacement compressor becomes unnecessary.

In accordance with the present invention, there is provided a clutch-less variable displacement compressor comprising the aforementioned displacement control valve.

A clutch-less variable displacement compressor is directly connected to an external power source. Therefore, it continues to run so long as the external power source operates even if the operation of the compressor becomes unnecessary. Provision of the forced opening mechanism for forcing the valve body to move away from the valve seat to open the valve hole when the electric supply to the electromagnetic actuator is stopped enables the displacement of the variable displacement compressor to rapidly decrease to the minimum level when the operation of the variable displacement compressor becomes unnecessary, thereby preventing unnecessary energy consumption.

Effect of the Invention

In the displacement control valve in accordance with the present invention, discharge chamber pressure does not act on the valve body in the opening and closing direction because crank chamber pressure acts on the opposite ends of the valve body. The crank chamber pressure is applied to the other end of the valve body not by disposing a pressure inlet passage but by disposing the other end of the valve body in a portion of the communication passage extending between a portion of the compressor on which discharge pressure acts and a crank chamber of the compressor closer to the crank chamber than the valve hole. Therefore, the structure of the displacement control valve in accordance with the present invention is simpler than that of the conventional displacement control valve. Even if discharge gas leaks to the side of the other end of the valve body through the space between the valve body and the supporting hole, the leaked gas does not affect to the crank chamber pressure acting on the other end of the valve body because the other end of the valve body is located in the communication passage and the communication passage has a sectional area large enough even to lead the discharge gas to the crank chamber. As a result, the crank chamber pressure reliably acts on the opposite ends of the valve body. Therefore, control characteristic of the suction chamber pressure does not deviate from the initial characteristic.

Best Mode for Carrying Out the Invention

Preferred embodiments of the present invention will be described.

As shown in FIG. 1, the variable displacement compressor 100 comprises a cylinder block 101 provided with a plurality of cylinder bores 101*a*, a front housing 102 opposing one end of the cylinder block 101, and a rear housing 104 opposing the other end of the cylinder block 101 with a valve plate 103 clamped between them.

The cylinder block 101 cooperates with the front housing 102 to define a crank chamber 105. A driving shaft 106 extends across the crank chamber 105. The driving shaft 106 passes through a swash plate 107. The swash plate 107 is connected to a rotor 108 fixed to the driving shaft 106 through a link 109. The driving shaft 106 supports the swash plate 107 variably at an inclination. A coil spring 110 is disposed between the rotor 108 and the swash plate 107 to force the swash plate 107 in a direction for decreasing the inclination to minimum level. A coil spring 111 is also provided. The coil spring 111 and the coil spring 110 are disposed to face opposite surfaces of the swash plate 107. The coil spring 111 forces the swash plate 107 in minimum inclination condition in the direction for increasing the inclination.

The driving shaft 106 extends out of the housing at one end through a boss 102*a* of the front housing 102 to be connected to a car engine not through an electromagnetic clutch but directly through a transmission. Therefore, the variable displacement compressor 100 is a clutch-less compressor. The car engine and the transmission are not shown in FIG. 1. A shaft seal 112 is disposed between the driving shaft 106 and the boss 102*a*.

The driving shaft 106 is supported radially and longitudinally by bearings 113, 114, 115 and 116.

Pistons 117 are inserted into the cylinder bores 101*a*, each piston 117 is provided with a concavity 117*a* at one end. The concavity 117*a* accommodates a pair of shoes 118 for slidably clamping the outer periphery of the swash plate 107. Rotation of the driving shaft 106 is converted to reciprocal movement of the piston 117 through the swash plate 107 and the shoes 118.

The rear housing 104 forms a suction chamber 119 and a discharge chamber 120. The suction chamber 119 communicates with the cylinder bores 101*a* through communication holes 103*a* formed in the valve plate 103 and suction valves. The discharge chamber 120 communicates with the cylinder bores 101*a* through discharge valves and communication holes 103*b* formed in the valve plate 103. The suction valves and the discharge valves are not shown in FIG. 1. The suction chamber 119 communicates with an evaporator of a car air conditioner not shown in FIG. 1 through a suction port 104*a*.

The front housing 102, the cylinder block 101, the valve plate 103 and the rear housing 104 cooperate to form a housing for accommodating a compression mechanism comprising the driving shaft 106, the rotor 108, the link 109, the swash plate 107, the shoes 118, the pistons 117, the cylinder bores 101*a*, the suction valves, the discharge valves, etc.

A muffler 121 is disposed outside the cylinder block 101. The muffler 121 is formed by a cylindrical wall 101*b* formed on the outer surface of the cylinder block 101 and a cover 122 having a cylindrical form closed at one end, independent of the cylinder block 101 and connected to the cylindrical wall 101*b* with a seal member inserted between them. A discharge port 122*a* is formed in the cover 122. The discharge port 122*a* connects to a condenser of the car air conditioner not shown in FIG. 1.

A communication passage 123 is formed through the cylinder block 101, the valve plate 103 and the rear housing 104 to communicate the muffler 121 with the discharge chamber 120. The muffler 121 and the communication passage 123 cooperate to form a discharge passage extending between the discharge chamber 120 and the discharge port 122*a*. The muffler 121 forms an expanded space disposed on the way of the discharge passage.

A check valve 200 is disposed in the muffler 121 to open and close the upstream end of the muffler 121.

The front housing 102, the cylinder block 101, the valve plate 103 and the rear housing 104 are disposed adjacent to each other with gaskets inserted between them and assembled as a unitary body with a plurality of through bolts. The gaskets are not shown in FIG. 1.

A displacement control valve 300 is fitted to the rear housing 104. The displacement control valve 300 controls the aperture of a communication passage 124 extending between the discharge chamber 120 and the crank chamber 105 to control the flow rate of discharge refrigerant gas passing into the crank chamber 105. The refrigerant gas in the crank chamber 105 is passed into the suction chamber 119 through spaces between the bearings 115, 116 and the driving shaft 106, a space 125 formed in the cylinder block 101 and an orifice hole 103*c* formed in the valve plate 103.

The displacement control valve 300 can variably control the internal pressure of the crank chamber 105 to variably control the displacement of the variable displacement compressor 100. The displacement control valve 300 controls the supply of electric current to a built-in solenoid based on an external control signal to control the displacement of the variable displacement compressor 100, thereby keeping the internal pressure of the suction chamber 119 introduced into a pressure sensitive chamber of the displacement control valve 300 through a communication passage 126 at a predetermined level. The displacement control valve 300 stops the supply of electric current to the built-in solenoid to compulsorily open the communication passage 124, thereby minimizing the displacement of the variable displacement compressor 100. The displacement control valve 300 can optimally control the suction pressure in response to the external environment.

The structure of the displacement control valve 300 will be described in detail.

As shown in FIG. 2, the displacement control valve 300 comprises a pressure sensitive chamber 302 formed in a valve casing 301 and communicating with the suction chamber 119 through a communication hole 301*a* and the communication passage 126, a bellows 303 disposed in the pressure sensitive chamber 302, provided with a vacuum inner space and a spring disposed in the inner space, and operating as a pressure sensitive member for receiving internal pressure of the suction chamber 119 (hereinafter called suction chamber pressure), a pressure sensitive rod 305*a* abutting the bellows 303 at one end and slidably supported by a support member 304 fixed to the valve casing 301, and a valve body 305*b* formed integrally with the pressure sensitive rod 305*a*, opening and closing a valve hole 301*c* at one end disposed in a valve chamber 306 in response to the telescopic motion of the bellows 303, and slidably supported by a supporting hole 301*b* formed in a bulkhead 301*h* at the other end portion.

The valve hole 301*c* communicates with the crank chamber 105 at one end through a space 317, a communication hole 301*e*, a space 318 and a communication hole 301*f*, and with the valve chamber 306 at the other end. The valve chamber 306 communicates with the discharge chamber 120 through a communication hole 301*d*. The communication hole 301*d*, the valve chamber 306, the valve hole 301*c*, the space 317, the communication hole 301*e*, the space 318 and the communication hole 301*f* form a part of the communication passage 124.

The other end of the valve body 305*b* is disposed in the space 318 and shut off from the valve chamber 306 by the bulkhead 301*h* in which the supporting hole 301*b* is formed. The other end of the valve body 305*b* is disposed in a portion of the communication passage 124 for communicating the discharge chamber 120 with the crank chamber 105 closer to the crank chamber 105 than the valve hole 301*c*.

The valve body 305*b* is provided with a cylindrical circumferential surface having a single diameter over the whole length extending from the one end thereof abutting a flat valve seat 301*g* formed around the valve hole 301*c* to the other end thereof located in the space 318 beyond the other end portion slidably supported by the supporting hole 301*b*. A concave 305*d* is formed in the one end of the valve body 305*b*. The outer peripheral portion of the concave 305*b* forms an annular sharp edge 305*c* to form the outer peripheral portion of the one end of the valve body 305*b* abutting the valve seat 301*g*. The radial width of the annular sharp edge 305*c* is set at 0.5 mm or less. As a result, the annular sharp edge 305*c* forming the outer peripheral portion of the one end of the valve body 305*b* line contacts the valve seat 301*g* when the valve body closes the valve hole.

The bellows 303 is supported by a bellows guide 314 at the end distanced from the pressure sensitive rod 305*a*. The bellows guide 314 is slidably supported by a pressure setting member 315 press fitted in the valve casing 301. A spring 316 is disposed between the pressure setting member 315 and the bellows guide 314 to force the bellows 303 in the direction for opening the valve. The set pressure of the displacement control valve 300 is adjusted by adjusting the press-fitting depth of the pressure setting member 315.

The displacement control valve 300 further comprises a solenoid rod 308 abutting the other end of the valve body 305*b* at one end and fixed to a movable iron core 307 at the other end, a fixed iron core 309 opposing the movable iron core 307 at a predetermined distance and allowing the solenoid rod 308 to pass through without contact, a spring 310 for forcing the movable iron core 307 in the direction for closing the valve, a cylindrical member 312 made of non-magnetic material and fixed to a solenoid case 311 to slidably support the outer peripheral portion of the movable iron core 307 and accommodate the fixed iron core 309, and an electromagnetic coil 313 accommodated in the solenoid case 311 to surround the cylindrical member 312.

The internal space of the cylindrical member 312 communicates with the space 318 through a space between the solenoid rod 308 and the fixed iron core 309. The space 318 communicates with the valve hole 301*c*. Therefore, the internal pressure of the crank chamber 105 (hereinafter called crank chamber pressure) acts on the opposite ends of the valve body 305*b*.

In the displacement control valve 300, the crank chamber pressure is applied to the other end of the valve body 305*b* not by disposing a pressure inlet passage as taught by Patent Document No. 1 but by disposing the other end of the valve body 305*b* in a portion of the communication passage 124 for communicating the discharge chamber 120 with the crank chamber 105 of the variable displacement compressor 100 closer to the crank chamber 105 than the valve hole 301*c*. Therefore, the structure of the displacement control valve 300 is simpler than that of the displacement control valve taught by Patent Document No. 1.

Even if discharge gas leaks to the side of the other end of the valve body 305*b* through the space between the valve body 305*b* and the supporting hole 301*b*, the leaked gas does not affect the crank chamber pressure acting on the other end of the valve body 305*b* because the other end of the valve body 305*b* is disposed in the communication passage 124 and the communication passage 124 has a sectional area large enough even to lead the discharge gas to the crank chamber 105. As a result, the crank chamber pressure reliably acts on the opposite ends of the valve body 305*b*. Therefore, the control characteristic of the suction chamber pressure does not deviate from the initial characteristic.

In the displacement control valve 300, the valve body 305*b* is provided with a cylindrical circumferential surface having a single diameter over the whole length and line contacts the valve seat 301*g* at the annular sharp edge 305*c* forming the outer peripheral portion of the one end when it closes the valve hole. The aforementioned structure can completely eliminate an action of the discharge chamber pressure on the valve body 305*b* in the opening and closing direction and completely prevent opening and closing control of the valve body from being impaired by the discharge chamber pressure.

When the concave 305*d* is formed on the one end of the valve body 305*b* with a narrow annular outer peripheral portion remaining, it becomes possible to make the outer peripheral portion of the one end of the valve body 305*b* form an annular sharp edge 305*c* for line contacting the valve seat 301*g*. The concave 305*d* makes it easy to form the annular sharp edge 305*c*.

In the displacement control valve 300, no space is formed between the annular sharp edge 305*c* of the valve body 305*b* and the valve seat 301*g* even if the central axis of the valve body 305*b* drifts in radial direction in the narrow space between the valve body and the supporting hole 301*b* because the valve seat 301*g* forms a flat surface. Therefore, leakage from the contact part between the annular sharp edge 305*c* of the valve body 305*b* and the valve seat 301*g* is prevented.

The control characteristic of the suction chamber pressure of the displacement control valve 300 is represented by formula (1) in FIG. 3. When the suction chamber pressure Ps is lower than the level indicated by the formula (1), the bellows 303 expands to move the annular sharp edge 305*c* of the valve body 305*b* away from the valve seat 301*g*, thereby opening the valve hole 301*c*, communicating the space 317 with the valve chamber 306 through the valve hole 301*c*, and opening the communication passage 124 extending between the discharge chamber 120 and the crank chamber 105. Refrigerant gas in the discharge chamber 120 is supplied to the crank chamber 105 through the communication passage 124 to increase the crank chamber pressure, thereby decreasing the inclination of the swash plate 107 to decrease the displacement of the variable displacement compressor 100 and increase the suction chamber pressure. When the suction chamber pressure Ps is higher than the level indicated by the formula (1), the bellows 303 shrinks to make the annular sharp edge 305*c* of the valve body 305*b* abut the valve seat 301*g*, thereby closing the valve hole 301*c*, shutting off the communication between the space 317 and the valve chamber 306 through the valve hole 301*c*, and closing the communication passage 124 extending between the discharge chamber 120 and the crank chamber 105. Refrigerant gas in the crank chamber 105 passes into the suction chamber 119 through spaces between the bearings 115, 116 and the driving shaft 106, the space 125 formed in the cylinder block 101, and the orifice hole 103*c* formed in the valve plate 103 to decrease the crank chamber pressure, thereby increasing the inclination of the swash plate 107 to increase the displacement of the variable displacement compressor 100 and decease the suction chamber pressure. A pressure sensitive mechanism formed by the bellows 303 and the valve body 305*b* self controls the suction chamber pressure Ps to the level indicated by the formula (1). An electromagnetic actuator formed by the solenoid rod 308, the movable iron core 307, the fixed iron core 309, the spring 310, the solenoid case 311, the cylindrical member 312 and the electromagnetic coil 313 changes the operation point of the pressure sensitive mechanism in response to the level of the electric current flowing through the electromagnetic coil 313.

A control characteristic of the displacement control valve 300 is that the suction chamber pressure Ps decreases as the supply of the electric current i to the electromagnetic coil 313 increases.

In the displacement control valve 300, the pressure sensitive mechanism and the electromagnetic actuator drive the valve body 305*b*. Providing the displacement control valve 300 with the pressure sensitive mechanism enhances the accuracy of the control of the suction chamber pressure. Providing the displacement control valve 300 with the electromagnetic actuator for changing the operating point of the pressure sensitive mechanism enables the control pressure of the suction chamber to be determined unitarily relative to the control electric current i.

In the displacement control valve 300, the spring 316 forces the valve body 305*b* to move away from the valve seat 301*g*, thereby forcibly opening the valve hole 301*c* when the electric current supply to the electromagnetic actuator is stopped. As a result, it becomes possible to rapidly decrease the displacement of the variable displacement compressor 100 when the operation of the variable displacement compressor 100 becomes unnecessary.

A second preferred embodiment of the present invention will be described.

As shown in FIG. 4, a displacement control valve 400 comprises a pressure sensitive chamber 402 communicating with the suction chamber 119 through a communication hole 412*e* formed in a valve casing 412 and the communication passage 126, a diaphragm 403 forming a part of the surrounding wall of the pressure sensitive chamber 402 and operating as a pressure sensing member for receiving the suction chamber pressure, a first movable iron core 404 disposed outside the pressure sensitive chamber 402 and adjacent the diaphragm 403 at one end, a fixed iron core 405 opposing the first movable iron core 404 with a predetermined spacing between them, a cylindrical member 406 for cooperating with the diaphragm 403 to form a vacuum space for accommodating the first movable iron core 404 and the fixed iron core 405, a first spring 408 disposed in the vacuum space to force the first movable iron core 404 toward the diaphragm 403 through a solenoid rod 407, an electromagnetic coil 409 disposed in a solenoid case 401 to surround the cylindrical member 406, a second movable iron core 410 disposed in the pressure sensitive chamber 402 to oppose the first movable iron core 404 with the diaphragm 403 disposed between them, a second spring 411 disposed in the pressure sensitive chamber 402 to force the second movable iron core 410 in the direction away from the diaphragm 403, a pressure sensitive rod 413*a* slidably supported by the valve casing 412 to abut the second movable iron core 410, and a valve body 413*b* formed integrally with the pressure sensitive rod 413*a*. One end of the valve body 413*b* is disposed in a valve chamber 414 communicating with the discharge chamber 120 through a communication hole 412*c*. The other end portion of the valve body 413*b* is slidably supported by a supporting hole 412*a* formed in a bulkhead 412*f*. The said one end of the valve body 413*b* opens and closes a valve hole 412*b* in response to the telescopic motion of the diaphragm 403.

The valve hole 412*b* communicates with the crank chamber 105 at one end through a space 418, a communication hole 412*d*, a space 419 and a communication hole 417*a* and with the valve chamber 414 at the other end. The valve chamber 414 communicates with the discharge chamber 120 through the communication hole 412*c*. The communication hole 412*c*, the valve chamber 414, the valve hole 412*b*, the space 418, the communication hole 412*d*, the space 419 and the communication hole 417*a* form a part of the communication passage 124 extending between the discharge chamber 120 and the crank chamber 105.

The other end of the valve body 413*b* is disposed in the space 419 to be shut off from the valve chamber 414 by the bulkhead 412*f* provided with the supporting hole 412*a*. The other end of the valve body 413*b* is disposed in the portion of the communication passage 124 closer to the crank chamber 105 than the valve hole 412*b*.

A third spring 416 is disposed in the space 419 to force the valve body 413*b* in the closing direction through a spring guide 415. An adjusting member 417 is screwed into the valve casing 412. The adjusting member 417 cooperates with the valve casing 412 to form the space 419 and abuts one end of the third spring 416 to adjust the biasing force of the third spring 416. The communication hole 417*a* is formed in the adjusting member 417.

The valve body 413*b* is provided with a cylindrical circumferential surface having a single diameter over the whole length extending from one end thereof abutting a flat valve seat 412*g* formed around the valve hole 412*b* to the other end thereof disposed in the space 419 beyond the other end portion slidably supported by the supporting hole 412*a*. A concave 413*d* is formed in the one end of the valve body 413*b*. The outer peripheral portion of the concave 413*d* forms an annular sharp edge 413*c* and also the outer peripheral portion of the one end of the valve body 413*b* abutting the valve seat 412*g*. The radial width of the annular sharp edge 413*c* is set at 0.5 mm or less. As a result, the annular sharp edge 413*c* forming the outer peripheral portion of the one end of the valve body 413*b* line contacts the valve seat 412*g* when the valve body closes the valve hole.

The crank chamber pressure acts on the opposite ends of the valve body 413*b*.

In the displacement control valve 400, the crank chamber pressure is applied to the other end of the valve body 413*b* not by disposing a pressure inlet passage as taught by Patent Document No. 1 but by disposing the other end of the valve body 413*b* in a portion of the communication passage 124 for communicating the discharge chamber 120 with the crank chamber 105 of the variable displacement compressor 100 closer to the crank chamber 105 than the valve hole 412*b*. Therefore, the structure of the displacement control valve 400 is simpler than that of the displacement control valve taught by Patent Document No. 1.

Even if discharge gas leaks to the side of the other end of the valve body 413*b* through the space between the valve body 413*b* and the supporting hole 412*a*, the leaked gas does not affect to the crank chamber pressure acting on the other end of the valve body 413*b* because the other end of the valve body 413*b* is disposed in the communication passage 124 and the communication passage 124 has a sectional area large enough even to lead the discharge gas to the crank chamber 105. As a result, the crank chamber pressure reliably acts on the opposite ends of the valve body 413*b*. Therefore, the control characteristic of the suction chamber pressure does not deviate from the initial characteristic.

In the displacement control valve 400, the valve body 413*b* is provided with a cylindrical circumferential surface having a single diameter over the whole length and line contacts the valve seat 412*g* at the annular sharp edge 413*c* forming the outer peripheral portion of the one end when it closes the valve hole. The aforementioned structure can completely eliminate an action of the discharge chamber pressure on the valve body 413*b* in the opening and closing direction and completely prevent opening and closing control of the valve body 413*b* from being impaired by the discharge chamber pressure.

When the concave 413*d* is formed on the one end of the valve body 413*b* with a narrow annular outer peripheral portion remaining, it becomes possible to make the outer peripheral portion of the one end of the valve body 413*b* form an annular sharp edge 413*c* for line contacting the valve seat 301*g*. The concave 413*d* makes it easy to form the annular sharp edge 413*c*.

In the displacement control valve 400, no space is formed between the annular sharp edge 413*c* of the valve body 413*b* and the valve seat 412*g* even if the central axis of the valve body 413*b* drifts in radial direction in the narrow space between the valve body and the supporting hole 412*a* because the valve seat 412*g* forms a flat surface. Therefore, leakage from the contact part between the annular sharp edge 413*c* of the valve body 413*b* and the valve seat 412*g* is prevented.

When the electric current is supplied to the electromagnetic coil 409 of the displacement control valve 400, the second movable iron core 410 is drawn and connected to the first movable iron core 404 with the diaphragm 403 clamped between them. Thus, the second movable iron core 410 is integrally connected to the diaphragm 403. Furthermore, the second movable iron core 410 is connected to the pressure sensitive rod 413*a* and also the valve body 413*b*. As a result, the valve body 413*b* operates in response to the suction chamber pressure and the electromagnetic force. The control characteristic of the suction chamber pressure of the displacement control valve 400 is represented by formula (2) in FIG. 3. When the suction chamber pressure Ps is lower than the level indicated by the formula (2), the diaphragm 403 expands toward the pressure sensitive chamber 402 to force the second movable iron core 410 in the direction for opening the valve, thereby moving the annular sharp edge 413*c* of the valve body 413*b* away from the valve seat 412*g* to open the valve hole 412*b*. The space 418 communicates with the valve chamber 414 through the valve hole 412*b* to open the communication passage 124 extending between the discharge chamber 120 and the crank chamber 105. Refrigerant gas in the discharge chamber 120 is supplied to the crank chamber 105 through the communication passage 124 to increase the crank chamber pressure, thereby decreasing the inclination of the swash plate 107 to decrease the displacement of the variable displacement compressor 100 and increase the suction chamber pressure. When the suction chamber pressure Ps is higher than the level indicated by the formula (2), the diaphragm 403 expands in the direction away from the pressure sensitive chamber 402 to draw the second movable iron core 410 in the direction for closing the valve. The annular sharp edge 413*c* of the valve body 413*b* abuts the valve seat 412*g* to close the valve hole 412*b*, thereby shutting off the communication between the space 418 and the valve chamber 414 through the valve hole 412*b*, and closing the communication passage 124 extending between the discharge chamber 120 and the crank chamber 105. Refrigerant gas in the crank chamber 105 passes into the suction chamber 119 through spaces between the bearings 115, 116 and the driving shaft 106, the space 125 formed in the cylinder block 101, and the orifice hole 103*c* formed in the valve plate 103 to decrease the crank chamber pressure, thereby increasing the inclination of the swash plate 107 to increase the displacement of the variable displacement compressor 100 and decease the suction chamber pressure. A pressure sensitive mechanism formed by the diaphragm 403 and the valve body 413*b* self controls the suction chamber pressure Ps to the level indicated by the formula (2). An electromagnetic actuator formed by the solenoid rod 407, the first movable iron core 404, the fixed iron core 405, the spring 408, the solenoid case 401, the cylindrical member 406, the electromagnetic coil 409 and the second movable iron core 410 changes the operation point of the pressure sensitive mechanism in response to the level of the electric current i flowing through the electromagnetic coil 409.

A control characteristic of the displacement control valve 400 is that the suction chamber pressure Ps decreases as the supply of the electric current i to the electromagnetic coil 409 increases.

In the displacement control valve 400, the pressure sensitive mechanism and the electromagnetic actuator drive the valve body 413*b*. Providing the displacement control valve 400 with the pressure sensitive mechanism enhances the accuracy of the control of the suction chamber pressure. Providing the displacement control valve 400 with the electromagnetic actuator for changing the operating point of the pressure sensitive mechanism enables the control pressure of the suction chamber to be determined unitarily relative to the control electric current.

In the displacement control valve 400, the biasing force of the second spring 411 is set at a level larger than that of the third spring 416. Therefore, the second spring 411 forces the valve body 413*b* to move away from the valve seat 412*g*, thereby forcibly opening the valve hole 412*b* when the electric current supply to the electromagnetic actuator is stopped. As a result it becomes possible to rapidly decrease the displacement of the variable displacement compressor 100 when the operation of the variable displacement compressor 100 becomes unnecessary.

In the displacement control valve 400, the valve chamber 414 can be communicated with the space 419 through a communication hole formed in the valve body 413*b* as shown in FIG. 5 instead through the valve hole 412*b* formed in the valve casing 412, the space 418 and the communication hole 412*d*. The communication hole is formed by a valve hole 413*e* formed in the one end of the valve body 413*b* and a hole 413*f* extending from the valve hole 413*e* to the other end of the valve body 413*b*. The pressure sensitive rod 413*a* is independent of the valve body 413*b*. One end of the pressure sensitive rod 413*a* abuts a bracket 420 press fitted in the valve hole 413*e* to drive the valve body 413*b*. The bracket 420 closes only a part of the valve hole 413*e*. Therefore, a part 413*e*' remains open. As a result, the valve chamber 414 communicates with the space 419 through a communication hole formed in the valve body 413*b* and comprising the valve hole 413*e* and the hole 413*f*. The outer peripheral portion of the one end of the valve body 413*b* forms an annular sharp edge 413*c* for abutting the valve seat 412*g* when the valve is closed. The valve hole 413*e* and the hole 413*f* form a part of the communication passage 124 extending between the discharge chamber 120 and the crank chamber 105.

When a part of the communication passage 124 is formed in the valve body 413*b*, it becomes unnecessary to form the said part in the valve casing 412 and the structure of the displacement control valve 400 is simplified.

As the clutch-less variable displacement compressor 100 is directly connected to the external power source, i.e., the car engine, it continues to run so long as the car engine operates even if the operation of the car air conditioner or the operation of the compressor becomes unnecessary. The displacement control valves 300 and 400 are provided with the mechanism for forcibly opening the valve hole 301*c* and the mechanism for forcibly opening the valve hole 412*b* or 413*e*, respectively. Therefore, it is possible to rapidly decrease the displacement of the clutch-less variable displacement compressor 100 to the minimum level when the operation of the clutch-less variable displacement compressor 100 becomes unnecessary, thereby preventing unnecessary energy consumption.

Discharge pressure portions other than the discharge chamber 120, for example the muffler 121, the communication passage 123, etc., can be communicated with the crank chamber 105.

The valve seats 301*g* and 412*g* can be made funnel-shaped.

The sectional are of the portions of the valve bodies 305*b* and 413*b* extending in the valve chambers 306 and 414 can be made different from that of the portions supported by the supporting holes 301*b* and 412*a* to make the discharge chamber pressure act on the valve bodies 305*b* and 413*b*.

The displacement control valves 300 and 400 can be made as internal control valves without electromagnetic actuators.

The displacement control valves 300 and 400 can be made as solenoid valves without pressure sensitive mechanisms.

The orifice hole 103*c* can be a variable flow rate aperture.

INDUSTRIAL APPLICABILITY

Variable displacement compressors using CO2 or R152a instead of R134a in common use nowadays can be equipped with the displacement control valves in accordance with the present invention.

Various kinds of variable displacement compressors such as wobble plate variable displacement compressors, motor driven variable displacement compressors, variable displacement compressors equipped with electromagnetic clutch, clutch-less variable displacement compressors, etc. can be equipped with the displacement control valves in accordance with the present invention.

BRIEF DESCRIPTION OF THE DRAWINGS

FIG. 3 is a view showing a control characteristic formula of the displacement control valve in accordance with the first preferred embodiment of the present invention and a control characteristic formula of the displacement control valve in accordance with the second preferred embodiment of the present invention.

BRIEF DESCRIPTION OF THE REFERENCE NUMERALS

Figure 1:
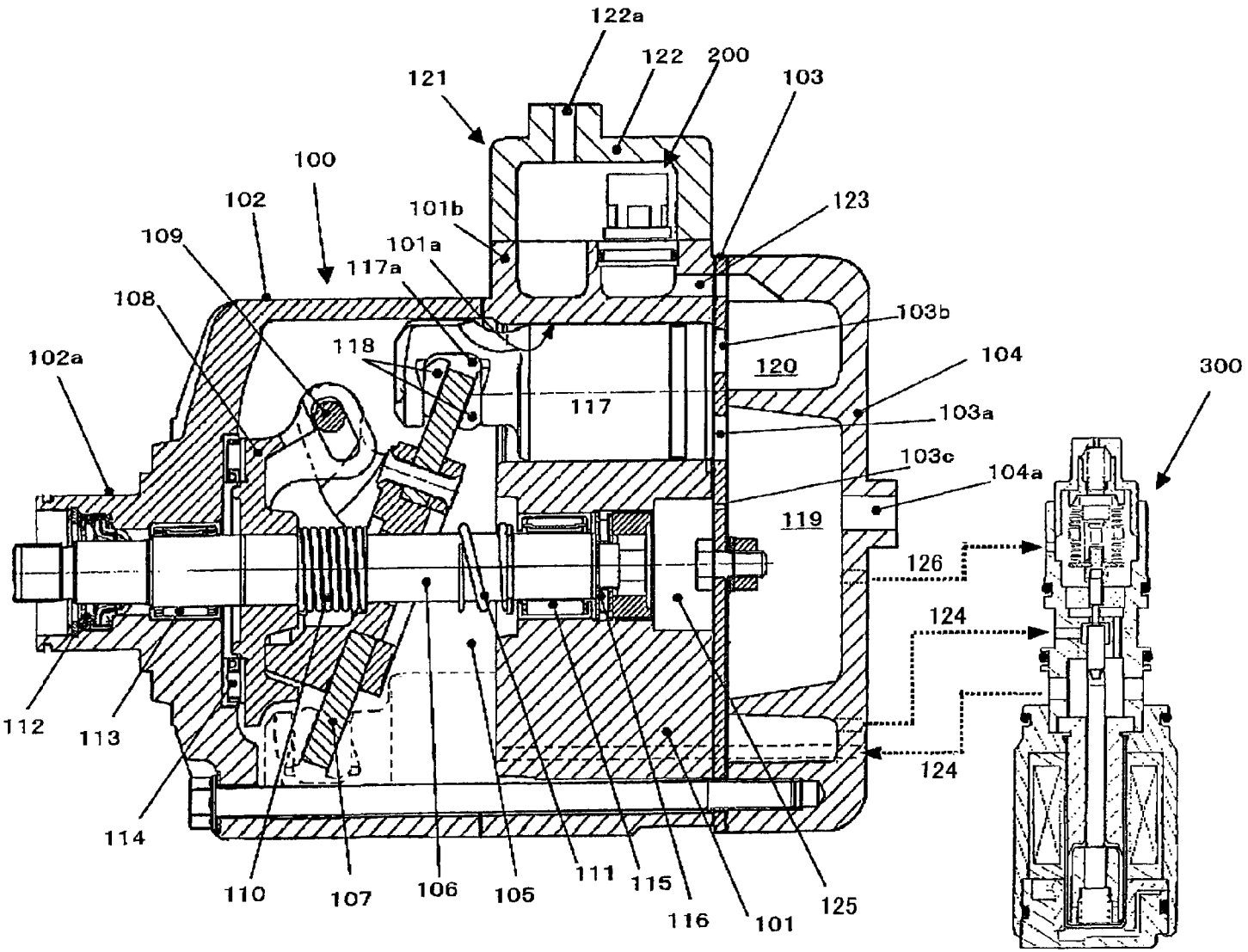
FIG. 1 is a sectional view of a variable displacement swash plate compressor provided with a displacement control valve in accordance with a preferred embodiment of the present invention.
Figure 2:
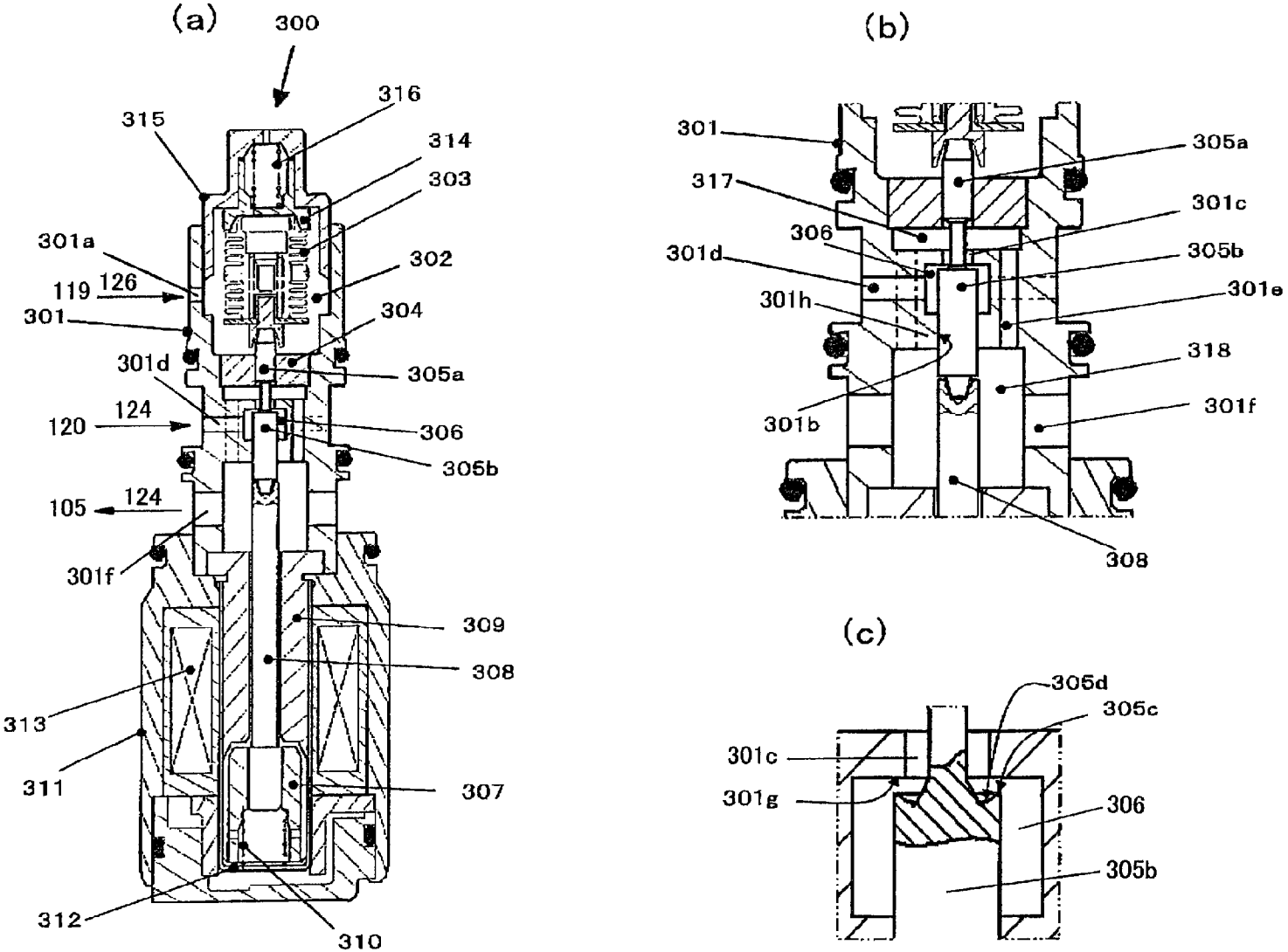
FIG. 2 is a set of sectional views of a displacement control valve in accordance with the first preferred embodiment of the present invention. (a) is a general sectional view, (b), (c) are fragmentary enlarged sectional views of (a).
Figure 4:
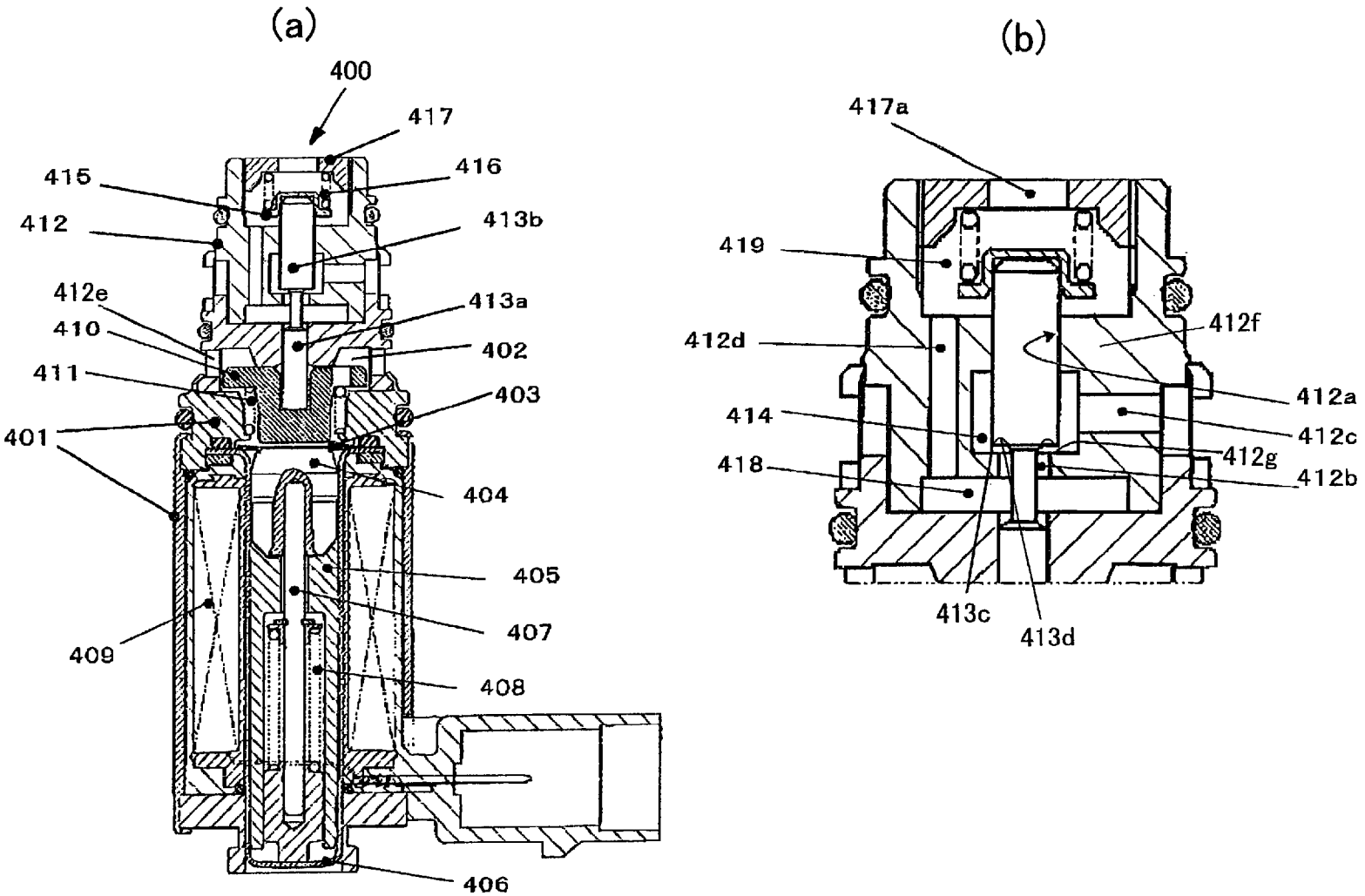
FIG. 4 is a set of sectional views of a displacement control valve in accordance with the second preferred embodiment of the present invention. (a) is a general sectional view, (b) is a fragmentary enlarged sectional view of (a).
Figure 5:
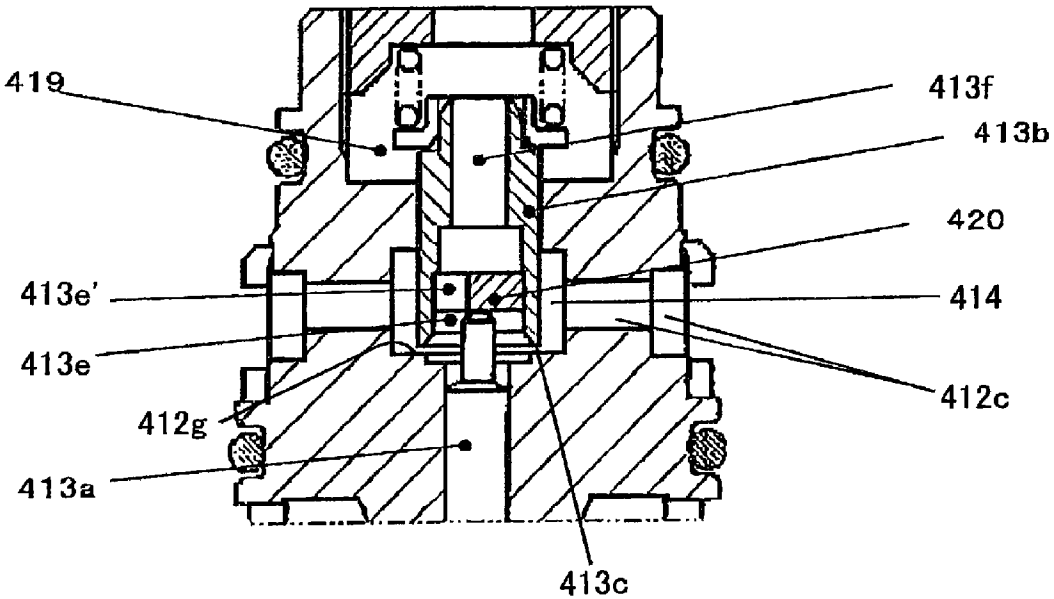
FIG. 5 is a fragmentary sectional view of a variation of the displacement control valve in accordance with the second preferred embodiment of the present invention.

100 Variable displacement swash plate compressor
119 Suction chamber
120 Discharge chamber
300, 400 Displacement control valve
305*b*, 413*b* Valve body
301*c*, 412*b*, 413*e* Valve hole
306, 414 Valve chamber
317, 318, 418, 419 Space
301*e*, 412 *d* Communication hole
305*c*, 413*c* Annular sharp edge An object of the present invention is to provide a displacement control valve of a variable displacement compressor for opening and closing a communication passage extending between a portion of the compressor on which discharge pressure acts and a crank chamber of the compressor, thereby controlling the displacement of the compressor, wherein discharge chamber pressure does not act on the valve body in the opening and closing direction, pressures acting on the opposite ends of the valve body are reliably maintained at the same level, and the structure thereof is simple.

A displacement control valve of a variable displacement compressor 100 for opening and closing a communication passage 124 extending between a portion 120 of the compressor on which discharge pressure acts and a crank chamber 105 of the compressor 100, thereby controlling the displacement of the compressor 100, comprises a valve hole 301*c* communicating with the crank chamber 105 at one end and opening to a valve chamber 306 at the other end, a valve body 305*b* for opening and closing the valve hole 301*c* at one end located in the valve chamber 306 communicating with the portion 120 of the compressor 100 on which discharge pressure acts, a bulkhead 301*h* provided with a supporting hole 301*b* for slidably supporting the valve body 305*b* and shutting the other end of the valve body 305*b* off from the valve chamber 306, and a driver for driving the valve body 305*b* in a direction for opening and closing the valve hole. The other end of the valve body 305*b* is disposed in a portion of the communication passage 124 closer to the crank chamber 105 than the valve hole 301*c*.

The invention claimed is:

1. A displacement control valve of a variable displacement compressor for opening and closing a communication passage extending between a portion of the compressor on which discharge pressure acts and a crank chamber of the compressor, thereby controlling the displacement of the compressor, comprising a valve hole communicating with the crank chamber at one end and opening to a valve chamber at the other end, a valve body for opening and closing the valve hole at one end located in the valve chamber communicating with the portion of the compressor on which discharge pressure acts, a bulkhead provided with a supporting hole for slidably supporting the valve body and shutting the other end of the valve body off from the valve chamber, and a driver for driving the valve body in a direction for opening and closing the valve hole, wherein the other end of the valve body is disposed in a portion of the communication passage closer to the crank chamber than the valve hole.

2. A displacement control valve of claim 1, wherein the valve body is provided with a cylindrical circumferential surface having a single diameter over the whole length and line contacts a valve seat at the outer peripheral portion of the one end when it closes the valve hole.

3. A displacement control valve of claim 2, wherein the valve seat forms a flat surface, a concavity is formed on the one end of the valve body, and the outer peripheral portion of the concavity forms an annular sharp edge to form the outer peripheral portion of the one end of the valve body.

4. A displacement control valve of claim 1, wherein the valve hole is formed in the one end of the valve body, a hole is formed in the valve body to extend from the valve hole to the other end of the valve body, and the valve hole formed in the one end of the valve body and the hole extending from the valve hole to the other end of the valve body form a part of the communication passage.

5. A displacement control valve of claim 1, wherein the driver comprises a pressure sensitive mechanism for self controlling the internal pressure of a suction chamber and an electromagnetic actuator for changing an operating point of the pressure sensitive mechanism.

6. A displacement control valve of claim 1, further comprising a forced opening mechanism for forcing the valve body to move away from the valve seat to open the valve hole when an electric supply to the electromagnetic actuator is stopped.

7. A clutch-less variable displacement compressor comprising a displacement control valve of claim 6.

8. A displacement control valve of claim 2, wherein the valve hole is formed in the one end of the valve body, a hole is formed in the valve body to extend from the valve hole to the other end of the valve body, and the valve hole formed in the one end of the valve body and the hole extending from the valve hole to the other end of the valve body form a part of the communication passage.

9. A displacement control valve of claim 3, wherein the valve hole is formed in the one end of the valve body, a hole is formed in the valve body to extend from the valve hole to the other end of the valve body, and the valve hole formed in the one end of the valve body and the hole extending from the valve hole to the other end of the valve body form a part of the communication passage.

10. A displacement control valve of claim 2, wherein the driver comprises a pressure sensitive mechanism for self controlling the internal pressure of a suction chamber and an electromagnetic actuator for changing an operating point of the pressure sensitive mechanism.

11. A displacement control valve of claim 3, wherein the driver comprises a pressure sensitive mechanism for self controlling the internal pressure of a suction chamber and an electromagnetic actuator for changing an operating point of the pressure sensitive mechanism.

12. A displacement control valve of claim 4, wherein the driver comprises a pressure sensitive mechanism for self controlling the internal pressure of a suction chamber and an electromagnetic actuator for changing an operating point of the pressure sensitive mechanism.

13. A displacement control valve of claim 8, wherein the driver comprises a pressure sensitive mechanism for self controlling the internal pressure of a suction chamber and an electromagnetic actuator for changing an operating point of the pressure sensitive mechanism.

14. A displacement control valve of claim 9, wherein the driver comprises a pressure sensitive mechanism for self controlling the internal pressure of a suction chamber and an electromagnetic actuator for changing an operating point of the pressure sensitive mechanism.

15. A displacement control valve of claim 2, further comprising a forced opening mechanism for forcing the valve body to move away from the valve seat to open the valve hole when an electric supply to the electromagnetic actuator is stopped.

16. A displacement control valve of claim 3, further comprising a forced opening mechanism for forcing the valve body to move away from the valve seat to open the valve hole when an electric supply to the electromagnetic actuator is stopped.

17. A displacement control valve of claim 4, further comprising a forced opening mechanism for forcing the valve body to move away from the valve seat to open the valve hole when an electric supply to the electromagnetic actuator is stopped.

18. A displacement control valve of claim 5, further comprising a forced opening mechanism for forcing the valve body to move away from the valve seat to open the valve hole when an electric supply to the electromagnetic actuator is stopped.

19. A displacement control valve of claim 8, further comprising a forced opening mechanism for forcing the valve body to move away from the valve seat to open the valve hole when an electric supply to the electromagnetic actuator is stopped.

20. A displacement control valve of claim 9, further comprising a forced opening mechanism for forcing the valve body to move away from the valve seat to open the valve hole when an electric supply to the electromagnetic actuator is stopped.

21. A displacement control valve of claim 10, further comprising a forced opening mechanism for forcing the valve body to move away from the valve seat to open the valve hole when an electric supply to the electromagnetic actuator is stopped.

22. A displacement control valve of claim 11, further comprising a forced opening mechanism for forcing the valve body to move away from the valve seat to open the valve hole when an electric supply to the electromagnetic actuator is stopped.

23. A displacement control valve of claim 12, further comprising a forced opening mechanism for forcing the valve body to move away from the valve seat to open the valve hole when an electric supply to the electromagnetic actuator is stopped.

24. A displacement control valve of claim 13, further comprising a forced opening mechanism for forcing the valve body to move away from the valve seat to open the valve hole when an electric supply to the electromagnetic actuator is stopped.

25. A displacement control valve of claim 14, further comprising a forced opening mechanism for forcing the valve body to move away from the valve seat to open the valve hole when an electric supply to the electromagnetic actuator is stopped.

* * * * *